US007775814B1

(12) United States Patent
Bhutani

(10) Patent No.: US 7,775,814 B1
(45) Date of Patent: Aug. 17, 2010

(54) SYSTEM AND METHOD FOR PROVIDING A REMOVABLE ISOLATOR FOR HIGH CURRENT CONNECTIONS

(75) Inventor: Gurmeet Bhutani, Taipei (TW)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 12/434,822

(22) Filed: May 4, 2009

(51) Int. Cl.
*H01R 13/44* (2006.01)

(52) U.S. Cl. ..... 439/149; 439/146

(58) Field of Classification Search ..... 339/135, 339/136, 146–149
See application file for complete search history.

(56) References Cited

U.S. PATENT DOCUMENTS

| | | | | |
|---|---|---|---|---|
| 3,986,894 | A | 10/1976 | Ciliberti, Jr. | |
| 4,270,057 | A | 5/1981 | Holt | |
| 6,062,908 | A | 5/2000 | Jones | |
| 6,153,329 | A | 11/2000 | Raschilla et al. | |
| 6,815,929 | B1 | 11/2004 | Dagan et al. | |
| 2008/0036419 | A1 | 2/2008 | Cook et al. | |
| 2008/0305664 | A1* | 12/2008 | Shishikura et al. | 439/148 |
| 2009/0197444 | A1* | 8/2009 | De Blieck | 439/149 |
| 2010/0009561 | A1* | 1/2010 | Wu et al. | 439/136 |
| 2010/0033913 | A1* | 2/2010 | Cao | 361/679.4 |

* cited by examiner

*Primary Examiner*—Ross N Gushi
(74) *Attorney, Agent, or Firm*—Baker Botts L.L.P.

(57) ABSTRACT

Shipment and storage of systems poses integrity and economical issues. Such systems may require substantial packaging to protect components of the system during shipment and storage. Some components, such as a battery, may need to be separated from the system during shipment to prevent either actual or perceived damage by the user of the system. A battery directly connected to a system may discharge so as to be incapable of providing sufficient power to the system. Users may erroneously believe that the system is defective and place unnecessary service calls. Such service calls increase costs and affect future business activity. Configuring the terminals of high current connectors coupled to the battery and the system allow for an isolator to be inserted between the high current connectors to prevent conduction while allowing the connectors to mate which results in feasibly shipping the battery in tact within the system.

20 Claims, 5 Drawing Sheets

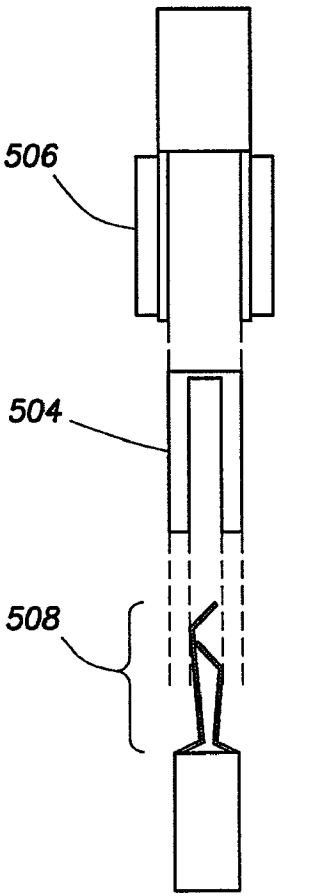
FIG.5B2
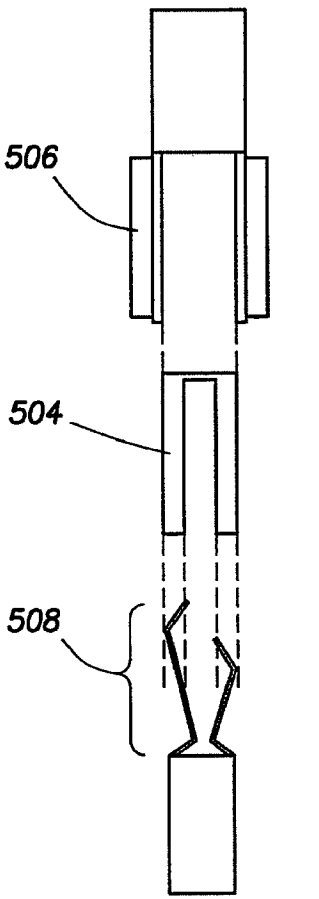
FIG.5B1
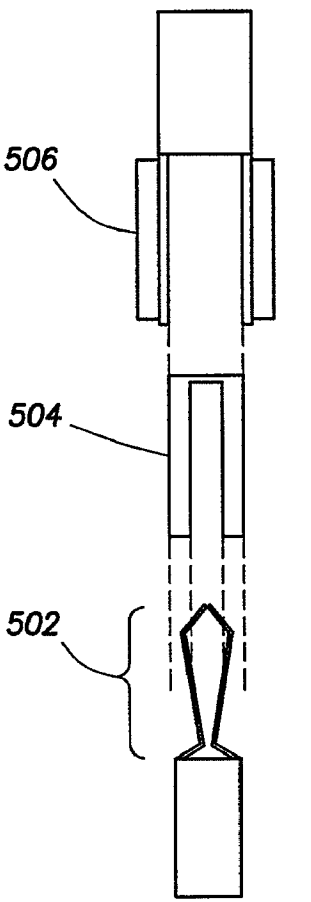
FIG.5A2
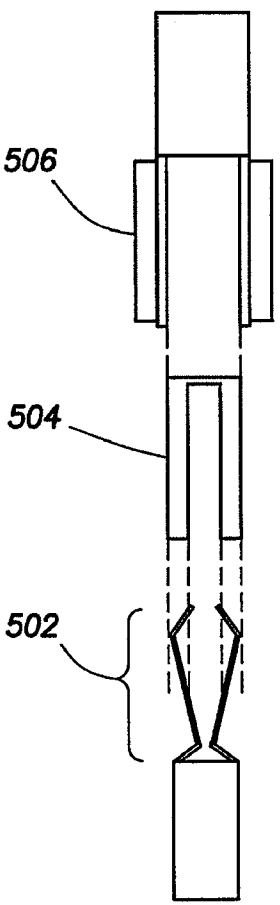
FIG.5A1

SYSTEM AND METHOD FOR PROVIDING A REMOVABLE ISOLATOR FOR HIGH CURRENT CONNECTIONS

TECHNICAL FIELD

The present disclosure relates generally to the operation of computer systems and information handling systems, and, more particularly, to providing a removable isolator for high current connections.

BACKGROUND

As the value and use of information continues to increase, individuals and businesses seek additional ways to process and store information. One option available to these users is an information handling system. An information handling system generally processes, compiles, stores, and/or communicates information or data for business, personal, or other purposes thereby allowing users to take advantage of the value of the information. Because technology and information handling needs and requirements vary between different users or applications, information handling systems may vary with respect to the type of information handled; the methods for handling the information; the methods for processing, storing or communicating the information; the amount of information processed, stored, or communicated; and the speed and efficiency with which the information is processed, stored, or communicated. The variations in information handling systems allow for information handling systems to be general or configured for a specific user or specific use such as financial transaction processing, airline reservations, enterprise data storage, or global communications. In addition, information handling systems may include or comprise a variety of hardware and software components that may be configured to process, store, and communicate information and may include one or more computer systems, data storage systems, and networking systems.

An information handling system may include a plurality of subsystems, e.g., processor blades, disk controllers, etc., these subsystems may operate at certain direct current (DC) voltages and currents. Generally, these DC voltages and currents may be supplied through at least one power supply. A common and economical information handling system power supply may comprise a battery. Commonly, a battery of an information handling system may be removable, for instance, the battery in a notebook computer. A removeable battery may be shipped as a separate unit from the information handling system or in tact within the information handling system.

SUMMARY

The shipment of information handling systems poses not only system integrity issues but economical issues as well. An information handling system may require substantial packaging and insulation to protect the components of the information handling system during shipment and storage. Some of these components may need to be separated from the information handling system during shipment to prevent either actual or perceived damage by the user of the components, e.g. the battery. A battery in tact within the information handling system, so as to conductively mate with the power system of the information handling system, over time may discharge or drain to the point where the battery may not retain a sufficient enough charge to provide an operational power level for the information handling system. Also, if a battery becomes over-drained, the battery may require charging for an extensive period of time in order for the battery to reach a charge that will allow the information handling system to function properly. Users of the information handling system may erroneously believe that the information handling system is defective and place an unwarranted and unnecessary service call. These types of service calls increase costs and may impede future business activity.

In accordance with the present disclosure, a system and method for isolating the high current connector of a removable battery and the high current connector of an information handling system. The removable battery is coupled to a first high current connector while the information handling system is coupled to a second high current connector. The two high current connectors are operable to conductively mate with one another to allow current to flow from the battery to the information handling system in a manner that provides adequate power to the information handling system. A pair of conductive prongs is coupled to the first high current connector, where the pair of conductive prongs comprises a first prong having a length and a width and a second prong having a length and a width, wherein the length of the second prong is shorter than the length of the first prong which allows a removable isolator to enclose the pair of conductive prongs without preventing the second high current connector from mating with the first high current connector. When the isolator encloses the pair of conductive prongs, the first high current connector and the second high current connector do not conductively mate. However, when the removable isolator is removed from the pair of conductive prongs, the first high current connector and the second high current connector are operable to conductively mate.

The system and method disclosed herein is technically advantageous because the removable battery is shipped in tact within the information handling system. The present invention requires the use of less packaging for the shipment of an information handling system to a desired location and reduces the overall cost of the informational handling system. Also, as the isolator prevents current leakage of the battery when in tact within the information handling system, the information handling system does not require the user to charge the battery for an extended period of time. Providing the user with a information handling system that does not require complex installation of the battery or charging of the battery may prevent unnecessary service calls and confusion to the user. Other technical advantages will be apparent to those of ordinary skill in the art in view of the following specification, claims, and drawings.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 5A1 is a schematic diagram of a prior art isolator for a high current connection with the female high current connection in an open position.

FIG. 5A2 is a schematic diagram of a prior art isolator for a high current connection with the female high current connection in a closed position.

FIG. 5B1 is a schematic diagram of an example embodiment of an isolator for a high current connection with the male high current connection in an open position.

FIG. 5B2 is a schematic diagram of an example embodiment of an isolator for a high current connection with the male high current connection in a closed position.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may include a removable battery for providing power to the components of the information handling system. The information handling system may also include one or more buses operable to transmit communications between the various hardware components.

Figure 1:
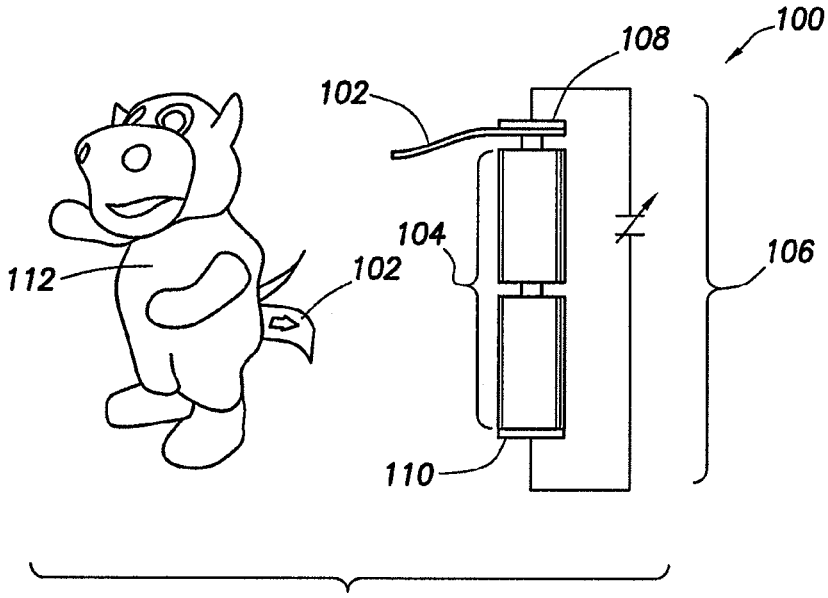
FIG. 1 (PRIOR ART)
FIG. 1 is a prior art diagram of an isolator for a low current connection.

Shown in FIG. 1 is a prior art solution for an isolator for a low current connection 100. The low current connection, shown generally as 106 in FIG. 1, typically has only two terminals 108, 110. Many consumer electronic devices, such as small toys, commonly ship and are stocked with one or more batteries in tact within the device. Generally, the devices are designed to require only a small number of terminals. Shown in FIG. 1 is a device, such as a toy, with only two terminals 108 and 110 that make contact with the batteries 104 aligned in series. In such cases, an isolator 102 may be a thin strip of plastic or other inexpensive non-conductive material that may be easily removed by a user slightly tugging on the isolator 102. The terminals 108 and 110 may be a simple design that does not require any special shape. For example, on typical lost cost solution provides that one terminal may be a conductive spring to hold the battery in position and an opposing terminal that may be a beveled or raised conductive surface. The low-cost simple isolator 102 is sufficient to prevent the conductive mating of the low current batteries 104 with the terminal 108 such that the device 112 may be shipped with the batteries 104 in tact within the device. The isolator 102 prevents the batteries 104 from discharging during shipment as the isolator 102 prevents the completion of the circuit 106. A user of the device 112 may simply gently tug the isolator 102 to remove the isolator 102 from the circuit 106 so as to allow a low current to flow to the device 112 and to allow the device 112 to operate as intended.

The simple isolator 102 shown in FIG. 1 provides isolation for a low current solution. The isolator 102 may not be suitable for high current connection systems, for instance, information handling systems. An information handling system may require a power supply that mates to multiple terminals to provide a sufficient connection between a battery with a higher current and voltage rating than the prior art system shown in FIG. 1. FIGS. 2 and 3, in general, depict high current connectors for an information handling system. FIG. 2 depicts an example male high current connector while FIG. 3 depicts an example female high current connector.

Figure 2A:
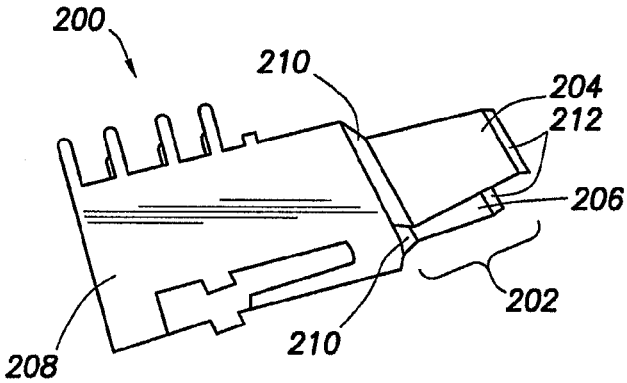
FIG. 2A is a drawing of a male insert of a high current connector.

FIG. 2A depicts an example of a male terminal 200 of a high current connector. The male terminal 200 may have a pair of conductive prongs 202, including prong 204 and prong 206, that allow a female high current connector, such as the female high current connector depicted in FIG. 3B as 306, to conductively mate with a male high current connector, such as the male high current connector depicted in FIG. 2B as 220. The male terminal 200 may be made of copper or any other highly conductive material suitable for conducting high current known to one of ordinary skill in the art.

The pair of conductive prongs 202 may vary in length and in width according to the amount of current that must be conducted and the mating requirements of the opposing mating male connector. The pair of conductive prongs 202 may have a prong 204 that is longer than opposing prong 206 so as to allow the conductive prongs to collapse into each other. The base 210 of each of the pair of conductive prongs 202 may have a bend that angles the individual prong 204 or 206 inward so as to form a spring prong that allows each prong to press together or compress to a closed position when a force is applied. When the force is removed, the shape of the base 210 allows the pair of conductive prongs 202 to expand or spring back to an open position so as to make a secure and stable conductive mating with a female high current connector. Each of the pair of conductive prongs 202 may have a bend 212 that allows the pair of conductive prongs to press together to a closed position. The bend 212 is operable to function as a guide for the pair of conductive prongs when mating with a female high current connector. The bend 212 may be formed by chamfering or any other method known to one of ordinary skill in the art.

Figure 2B:
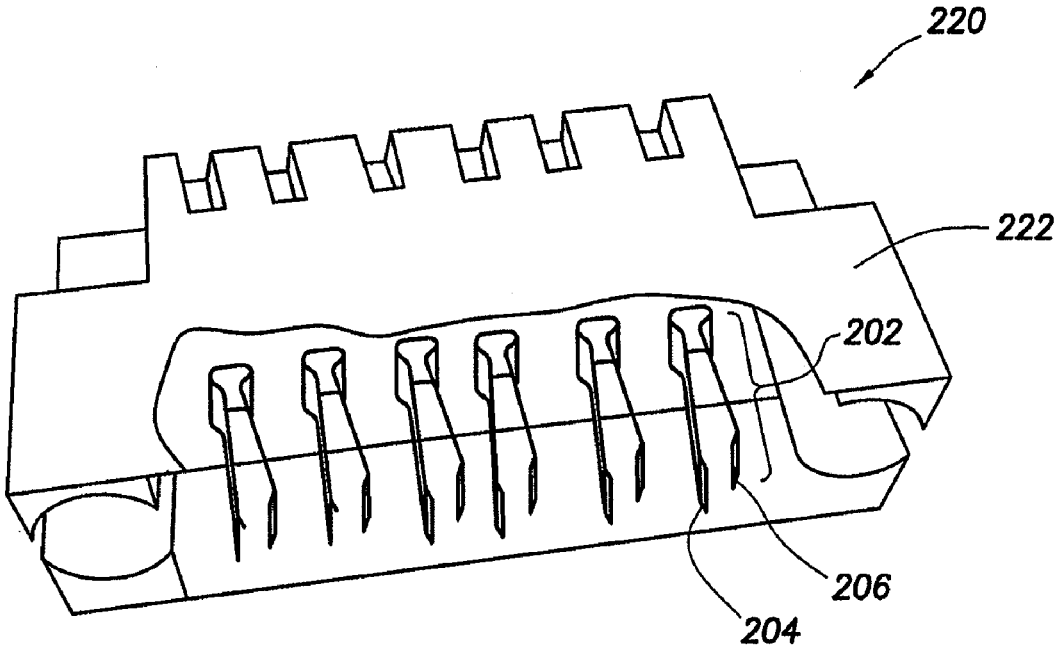
FIG. 2B is a drawing of a male high current connector.

FIG. 2B depicts one example of a male high current connector 220. The male high current connector 220 may have an outer casing 222. Outer casing 222 may be made of plastic such as PBT and nylon or any other suitable durable moldable material that provides for high dielectric strength known to one of ordinary skill in the art. The male terminal 200 fits inside the outer casing 220 so as to allow the base 208, shown in FIG. 2A, to make a conductive coupling to a battery or a battery pack. The pair of conductive prongs 202 protrude from one side as shown in FIG. 2B to allow the coupled battery to conductively mate with the female high current connector 306 depicted in FIG. 3B.

Figure 3A:
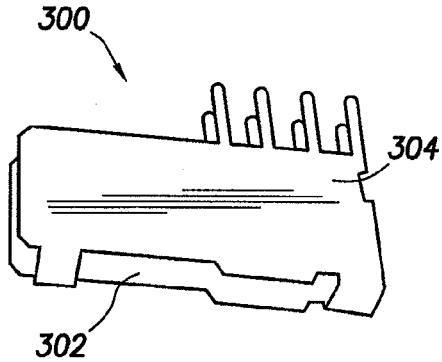
FIG. 3A is a drawing of a female insert of a high current connector.

FIG. 3A depicts one example of female terminal 300 of a high current connector. The female terminal 300 may be made of copper or any other highly conductive material suitable for conducting high current known to one of ordinary skill in the art. The interior 302 of female terminal 300 allows for the conductive mating of male terminal 200. The pair of conductive prongs 202 provide a guide for the male terminal 200 to conductively mate with the female terminal 300 as discussed in further detail below with respect to FIG. 5.

Figure 3B:
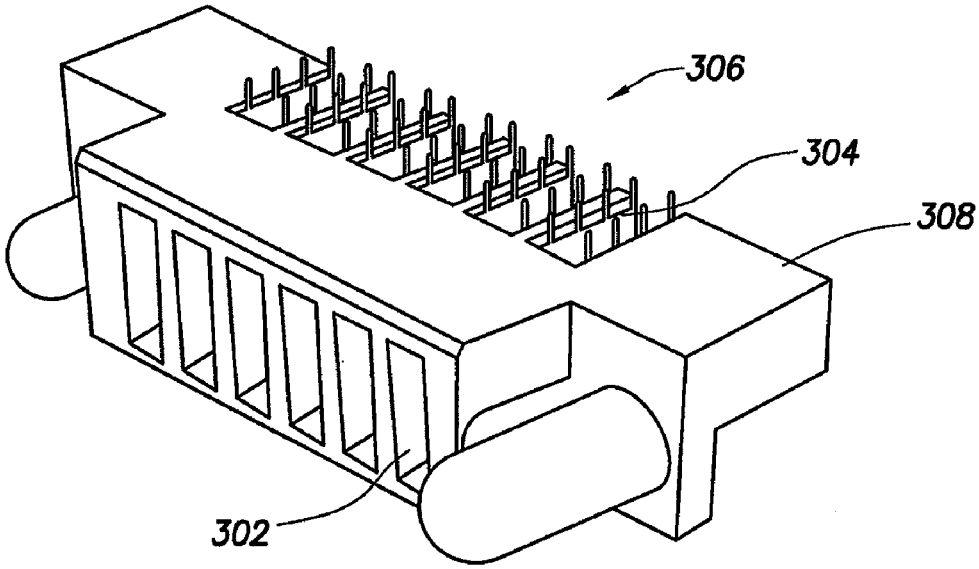
FIG. 3B is a drawing of a female high current connector.

FIG. 3B depicts one example of a female high current connector 306. The female high current connector 306 may have an outer casing 308. Outer casing 308 may be made of plastic such as PBT and nylon or any other suitable durable moldable material that provides for high dielectric strength known to one of ordinary skill in the art. The female terminal 300 fits inside the outer casing 308 so as to allow the base 304, shown in FIG. 3A, to make a conductive coupling to the information handling system or any other system or device requiring an interface to a high current battery or other power supply.

Figure 4:
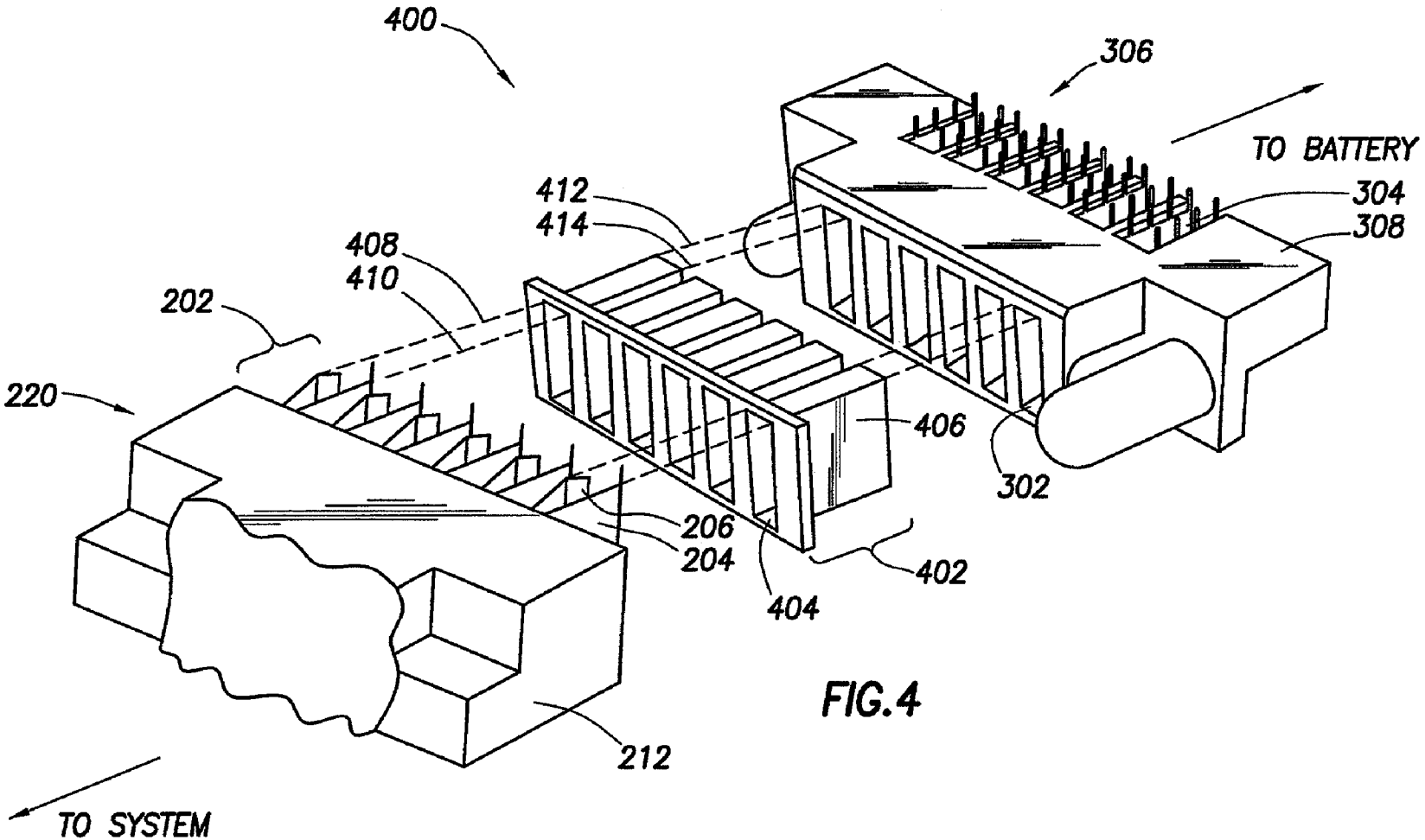
FIG. 4 is a schematic diagram of an isolator for a high current connection according to an example embodiment of the present disclosure.

FIG. 4 depicts an example of an apparatus for isolating high current connectors, generally depicted as 400. In one example, the female high current connector 306 conductively couples to the battery and the male high current connector 220 conductively couples to a system, such as an information handling system. The high current connectors 306 and 220 may be interchangeable depending on the requirements of the system and the battery such that female high current connector 306 conductively couples to the system and the male high current connector 220 conductively couples to the battery. While high current connectors 306 and 220 shown in FIG. 4 are configured for a six terminal connection, any number of conductive terminal connections may exist according to the requirements and design of a particular system.

In one example, isolator 402 is a single molded isolator such that each of the conductive pair of prongs 202 may be enclosed by the inner casing 404 of the isolator 402 with outer casing 406 joining each inner casing 404 so as to allow for a single isolator 402 to be inserted over and removed from each pair of conductive prongs 202. In another example, multiple isolators 402 may be used such that the outer casing 406 does not join each and every inner casing. Isolator 402 may be made of any type of durable moldable material that provides for a high dielectric strength such as plastic. As an example, isolator 402 may be made of PBT or nylon or any other suitable material known to one of ordinary skill in the art.

As depicted in FIG. 4 by guidelines 408, 410, 412, and 414, the isolator 402 is configured to enclose each pair of conductive prongs 202 of the male high current connector 220 and to mate with the female high current connector 306. Placing the isolator 402 between the female high current connector 306 and the male high current connector 220 prevents conduction between the battery and the system when the male high current connector 220 and the female high current connector 306 are mated, allowing the battery to be shipped in tact within the system.

Such a design as described in FIG. 4 provides a cost-effective solution for packaging a battery or battery pack in tact within the system. As isolator 402 prevents any current discharge, the battery may have sufficient charge to power the system when the isolator 402 is removed preventing an unwarranted, costly and unnecessary service call. The isolator 402 is easy for a user to remove and allows the user to quickly conductively mate the battery to the system without any further instruction or direction. Such a design allows for smaller packaging as the battery does not need to be packaged separately and provides the additional benefit of preventing the battery from discharging prior to use by a user of the system.

FIGS. 5A1 and 5A2 depict a pair of conductive prongs 502 that do not allow for mating with male high current connector 506 when isolator 504 encloses the pair of conductive prongs 502. FIG. 5A1 depicts the pair of conductive prongs 502 in an open position such that the isolator 504 may not enclose the pair of conductive prongs 502. FIG. 5A2 depicts the pair of conductive prongs 502 in a closed position. Each prong of the pair of conductive prongs 502 has the same length such that when the pair of conductive prongs 502 is in the closed position, the isolator 504 cannot enclose the pair of conductive prongs 502 and mate with the female high current connector 506.

FIGS. 5B1 and 5B2 depict a pair of conductive prongs 508 that allow for mating with female high current connector 506 when isolator 504 encloses the pair of conductive prongs 502. FIG. 5B1 depicts the pair of conductive prongs 508 in an open position such that the isolator 504 may not enclose the pair of conductive prongs 508. FIG. 5B2 depicts the pair of conductive prongs 508 in a closed position. The pair of conductive prongs are configured as described above with respect to FIG. 2A. The pair of conductive prongs 508 collapse into a closed position such that isolator 504 may enclose the pair of conductive prongs 508 and still mate with female high current connector 506. When isolator 504 is removed from the pair of conductive prongs 508, the pair of conductive prongs 504 spring back to an open position and may conductively mate with the female high current connector 506.

Figure 6:
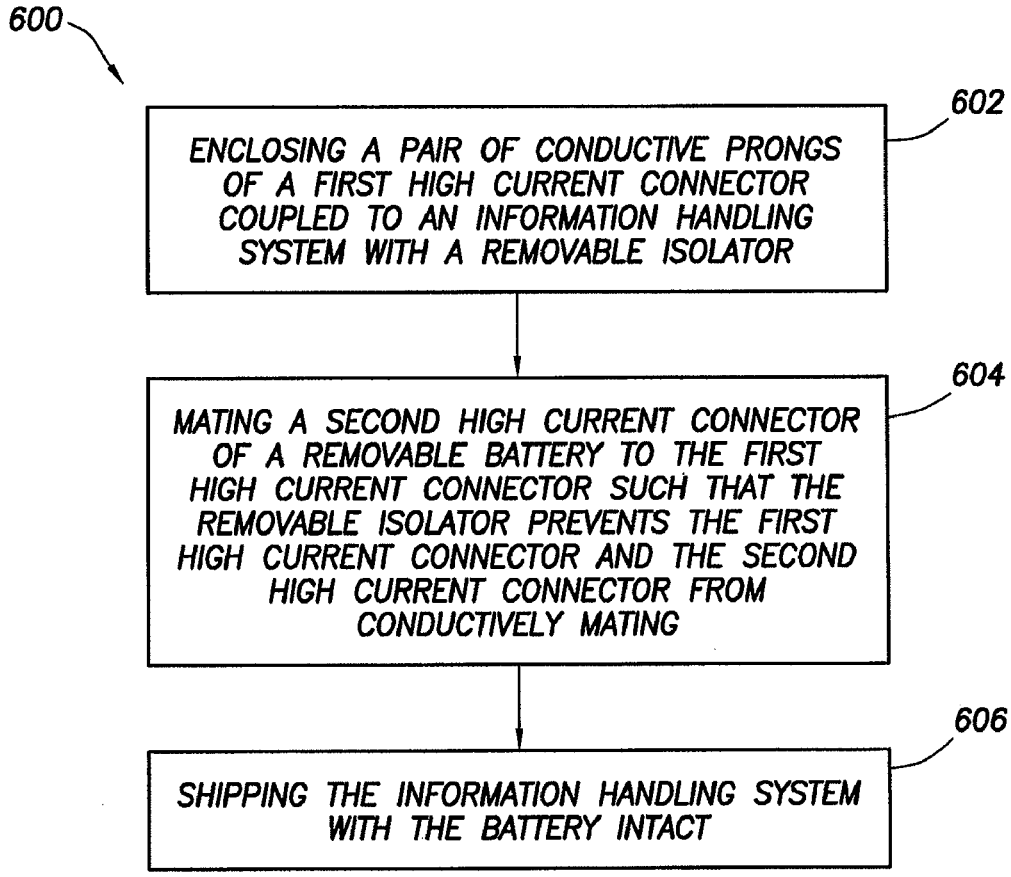
FIG. 6 is a flow diagram of an example method for providing an isolator for a high current connector.

FIG. 6 is diagram of an example method 600 for providing an isolator for a high current connector of a removable battery and an information handling system. In one example, the pair of conductive prongs of a first high current connector coupled to an information handling system are enclosed by a removable isolator (block 602) wherein the pair of conductive prongs has a first prong having a length and a width with a first bend and a second prong having a length and a width with a second bend. The first bend and the second bend allow the pair of conductive prongs to press together without causing the first bend and the second bend to align which allows the pair of prongs to press together to a closed position so as to allow for enclosure by the removable isolator. It is also within the scope of the present invention that the width and length of the pair of conductive prongs may be altered or manufactured in such a way so as to allow for the pair of conductive prongs to align in such a manner as to form the closed position for enclosure by the removable isolator while still allowing the pair of conductive prongs to conductively mate with a second high current connector once the isolator is removed.

Next, the first high current connector is mated with a second high current connector of a removable battery (block 604) such that the isolator prevents the first high current connector and the second high current connector from conductively mating. Finally, the information handling system may be shipped with the removable battery in tact (block 606) within the information handling system as the isolator prevents the battery from discharging during shipment.

Although the present disclosure has been described in detail, it should be understood that various changes, substitutions, and alterations can be made hereto without departing from the spirit and the scope of the invention as defined by the appended claims.

What is claimed is:

1. An apparatus for isolating high current connectors in an information handling system, the apparatus comprising:

a removable battery;

a first high current connector coupled to the removable battery;

a second high current connector coupled to the information handling system, wherein the second high current connector is operable to conductively mate with the first high current connector;

a pair of conductive prongs coupled to one of the first high current connector or the second high current connector, wherein the pair of conductive prongs comprises:

a first prong having a length and a width; and a second prong having a length and a width, wherein the length of the second prong is shorter than the length of the first prong;

a removable isolator operable to enclose the pair of conductive prongs without preventing the second high current connector from mating with the first high current connector;

wherein when the removable isolator encloses the pair of conductive prongs, the first high current connector and the second high current connector do not conductively mate; and wherein when the removable isolator is removed from the pair of conductive prongs, the first high current connector and the second high current connector conductively mate.

2. The apparatus of claim 1:

wherein the first prong is a spring prong;

wherein the second prong is a spring prong;

wherein the first prong and the second prong are operable to press together to a closed position when enclosed by the removable isolator; and wherein the first prong and the second prong spring to an open position when the isolator is removed from the pair of conductive prongs.

3. The apparatus of claim 1, wherein the first prong has a first bend;

wherein the second prong has a second bend; and wherein the first bend and the second bend allow the pair of conductive prongs to press together without causing the first bend and the second bend to align.

4. The apparatus of claim 3, wherein the first bend of the first prong is formed by chamfering, and wherein the second bend of the second prong is formed by chamfering.

5. The apparatus of claim 3, wherein the pair of conductive prongs form a guide to allow the second high current connector to mate with the first high current connector.

6. The apparatus of claim 1 further comprising:

a first non-conductive outer casing, wherein the first non-conductive outer casing encloses the first high current connector and wherein the first non-conductive outer casing has a high dielectric strength; and a second non-conductive outer casing, wherein the second non-conductive outer casing encloses the second high current connector and wherein the second non-conductive outer casing has a high dielectric strength.

7. The apparatus of claim 6, wherein the first non-conductive outer casing and the second non-conductive outer casing are made of one of PBT or nylon.

8. The apparatus of claim 1, wherein the isolator has a high dielectric strength.

9. The apparatus of claim 1, wherein the isolator is made of one of PBT or nylon.

10. The apparatus of claim 1, wherein the pair of conductive prongs is coupled to the second high current connector.

11. A system for an interface of a battery to high current connectors in an information handling system comprising:

a removable battery for providing power to an information handling system;

a removable interface between the removable battery and the information handling system, wherein the removable interface acts as a high current isolator;

a first high current connector coupled to the removable battery;

a second high current connector coupled to the information handling system, wherein the second high current connector is operable to conductively mate with the first high current connector when the removable interface is not present;

a pair of conductive prongs coupled to the second high current connector, wherein the pair of conductive prongs comprises:

a first prong having a length and a width; and a second prong having a length and a width, wherein the length of the second prong is shorter than the length of the first prong;

wherein the removable interface is operable to enclose the pair of conductive prongs without preventing the second high current connector from mating with the first high current connector, and wherein the removable interface prevents the pair of conductive prongs from conductively mating with the first high current connector; and wherein when the removable interface is not present the first high current connector and the second high current connector conductively mate.

12. The system of claim 11:

wherein the first prong is a spring prong;

wherein the second prong is a spring prong;

wherein the first prong and the second prong are operable to press together to a closed position when enclosed by the removable interface; and wherein the first prong and the second prong spring to an open position when the removable interface is removed from the pair of conductive prongs.

13. The system of claim 11, wherein the first prong has a first bend;

wherein the second prong has a second bend; and wherein the first bend and the second bend allow the pair of conductive prongs to press together without causing the first bend and the second bend to align.

14. The system of claim 13, wherein the first bend of the first prong is formed by chamfering, and wherein the second bend of the second prong is formed by chamfering.

15. The system of claim 13, wherein the pair of conductive prongs form a guide to allow the second high current connector to mate with the first high current connector.

16. The system of claim 11 further comprising:

a first non-conductive outer casing, wherein the first non-conductive outer casing encloses the first high current connector and wherein the first non-conductive outer casing has a high dielectric strength; and a second non-conductive outer casing, wherein the second non-conductive outer casing encloses the second high current connector and wherein the second non-conductive outer casing has a high dielectric strength.

17. The system of claim 16, wherein the first non-conductive outer casing and the second non-conductive outer casing are made of one of PBT or nylon.

18. The system of claim 11, wherein the removable interface has a high dielectric strength.

19. The system of claim 11, wherein the removable interface is made of one of PBT or nylon.

20. A method for providing a removable isolator for a removable battery in an information handling system, comprising:

enclosing a pair of conductive prongs of a first high current connector with a removable isolator, wherein the first high current connector is coupled to an information handling system, and wherein the pair of conductive prongs comprises:

a first prong having a length and a width, wherein the first prong has a first bend;

a second prong having a length and a width, wherein the length of the second prong is shorter than the length of the first prong, and wherein the second prong has a second bend, wherein:

the first bend and the second bend allow the pair of conductive prongs to press together without causing the first bend and the second bend to align; and the first prong and the second prong are operable to press together to a closed position when enclosed by the removable isolator;

mating a second high current connector of a removable battery to the first high current connector; and wherein the removable isolator prevents the first high current connector and the second high current connector from conductively mating.

* * * * *